US008854350B2

(12) United States Patent
Jeong et al.

(10) Patent No.: US 8,854,350 B2
(45) Date of Patent: Oct. 7, 2014

(54) LIQUID CRYSTAL DISPLAY AND DRIVING METHOD THEREOF

(75) Inventors: Jae-Won Jeong, Seoul (KR); Su-Bin Park, Incheon (KR); Woo-Jin Jung, Seoul (KR); Woo-Young Lee, Daegu (KR); Kang-Hyun Kim, Seoul (KR); Duc-Han Cho, Incheon (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 233 days.

(21) Appl. No.: 13/315,447

(22) Filed: Dec. 9, 2011

(65) Prior Publication Data

US 2012/0320019 A1 Dec. 20, 2012

(30) Foreign Application Priority Data

Jun. 17, 2011 (KR) ..... 10-2011-0059257

(51) Int. Cl.

| | |
|---|---|
| ***G09G 5/00*** | (2006.01) |
| ***G09G 3/36*** | (2006.01) |
| ***G09G 3/20*** | (2006.01) |
| *G09G 5/06* | (2006.01) |

(52) U.S. Cl.

CPC ..... *G09G 3/3648* (2013.01); *G09G 2320/0673* (2013.01); *G09G 5/06* (2013.01); *G09G 3/3655* (2013.01); *G09G 2320/103* (2013.01); *G09G 3/2096* (2013.01); *G09G 2300/0447* (2013.01); *G09G 2370/08* (2013.01)

USPC ..... 345/211; 345/87

(58) Field of Classification Search

USPC ..... 345/427, 87, 88, 76, 77, 1.1, 89, 98, 345/204, 501, 690; 370/257; 375/240.1, 375/240.01; 382/232, 251; 386/243; 349/43, 144; 455/566

See application file for complete search history.

(56) References Cited

U.S. PATENT DOCUMENTS

| | | | | |
|---|---|---|---|---|
| 7,148,868 | B2 * | 12/2006 | Lee | 345/87 |
| 7,532,269 | B2 * | 5/2009 | Ahn | 349/43 |
| 8,213,996 | B2 * | 7/2012 | Shim et al. | 455/566 |
| 2003/0231154 | A1 | 12/2003 | Yeo et al. | |
| 2004/0046724 | A1 | 3/2004 | Woo et al. | |
| 2008/0094333 | A1 * | 4/2008 | Oh et al. | 345/89 |
| 2008/0309590 | A1 | 12/2008 | Hong et al. | |
| 2009/0167659 | A1 | 7/2009 | Kim et al. | |
| 2009/0237340 | A1 | 9/2009 | Park et al. | |
| 2009/0315872 | A1 | 12/2009 | Ikeda et al. | |
| 2010/0033414 | A1 * | 2/2010 | Jeong et al. | 345/89 |

FOREIGN PATENT DOCUMENTS

| | | |
|---|---|---|
| KR | 1020060059014 | 6/2006 |
| KR | 1020070002177 | 1/2007 |
| KR | 1020080028730 | 4/2008 |
| KR | 100840331 | 6/2008 |
| KR | 1020090094693 | 9/2009 |
| KR | 1020090105176 | 10/2009 |

* cited by examiner

*Primary Examiner* — Sumati Lefkowitz
*Assistant Examiner* — Douglas M Wilson
(74) *Attorney, Agent, or Firm* — F. Chau & Associates, LLC

(57) ABSTRACT

Provided is a liquid crystal display for improving side visibility by calculating a representative value for image data and correcting at least one of a storage voltage Vcst, a reference voltage Vref, and a lookup table LUT according to the calculated representative value. Further, a histogram analysis block is formed inside or outside a signal controller and corrects at least one of the storage voltage Vcst, the reference voltage Vref, and the lookup table LUT based on the histogram analysis block.

14 Claims, 12 Drawing Sheets histogram of Blue data histogram of Red data histogram of Blue data histogram of Red data histogram of RGB data histogram of Green data

LIQUID CRYSTAL DISPLAY AND DRIVING METHOD THEREOF

CROSS-REFERENCE TO RELATED APPLICATION

This application claims priority to and the benefit of Korean Patent Application No. 10-2011-0059257 filed in the Korean Intellectual Property Office on Jun. 17, 2011, the entire contents of which are herein incorporated by reference.

BACKGROUND (a) Technical Field

The embodiments of the present invention relate to a liquid crystal display and a driving method of the liquid crystal display.

(b) Discussion of the Related Art

A liquid crystal display (LCD) is one of flat panel displays. An LCD panel includes two sheets of substrates with field generating electrodes and a liquid crystal layer interposed between the two substrates. The liquid crystal display generates electric fields in the liquid crystal layer by applying a voltage to the field generating electrodes, and determines the direction of liquid crystal molecules of the liquid crystal layer by the generated electric fields to control polarization of incident light, thereby displaying images.

In a vertical alignment mode liquid crystal display, a long axis of the liquid crystal molecules is arranged to be perpendicular to upper and lower substrates of a display panel while no electric field is applied to the substrates.

In a vertical alignment mode liquid crystal display, front visibility of an image is generally better than side visibility. Therefore, a need exists to improve the side visibility in the vertical alignment mode liquid crystal display.

SUMMARY

Embodiments of the present invention provide a liquid crystal display having improved side visibility and a driving method of the liquid crystal display.

An exemplary embodiment of the present invention provides a liquid crystal display including a display panel connected to a gate line and a data line and including a pixel receiving a storage voltage, a data driver connected to the data line to apply a data voltage to the data line, a gate driver connected to the gate line to apply a gate voltage to the gate line, a gray voltage generator connected to the data driver and generating a gray voltage based on a reference voltage, a driving voltage generator generating a driving voltage, a signal controller controlling the data driver, the gate driver, and the driving voltage generator and correcting input image data with reference to a lookup table, and a histogram analysis block analyzing a histogram of the image data during one frame to change at least one of the storage voltage, the reference voltage, and the lookup table.

An exemplary embodiment of the present invention provides a driving method of a liquid crystal display, including receiving input data from an outside source during one frame, analyzing a histogram for the received input data, calculating a representative value based on the histogram analysis, and changing at least one of a storage voltage, a reference voltage, and a lookup table based on the representative value.

An exemplary embodiment of the present invention provides a method of driving a display apparatus comprising determining a representative gray value for image data input during a frame, wherein the representative gray value is a gray average value of the entire grays of the image data, comparing the representative gray value with a reference value, and changing a storage voltage or a data voltage based on a result of the comparison.

According to the exemplary embodiments of the present invention, side visibility can be improved by calculating a representative value for an inputted image data and correcting at least one of a storage voltage Vcst, a reference voltage Vref, and a lookup table LUT depending on the representative value.

DETAILED DESCRIPTION OF THE EMBODIMENTS

Figure 1:
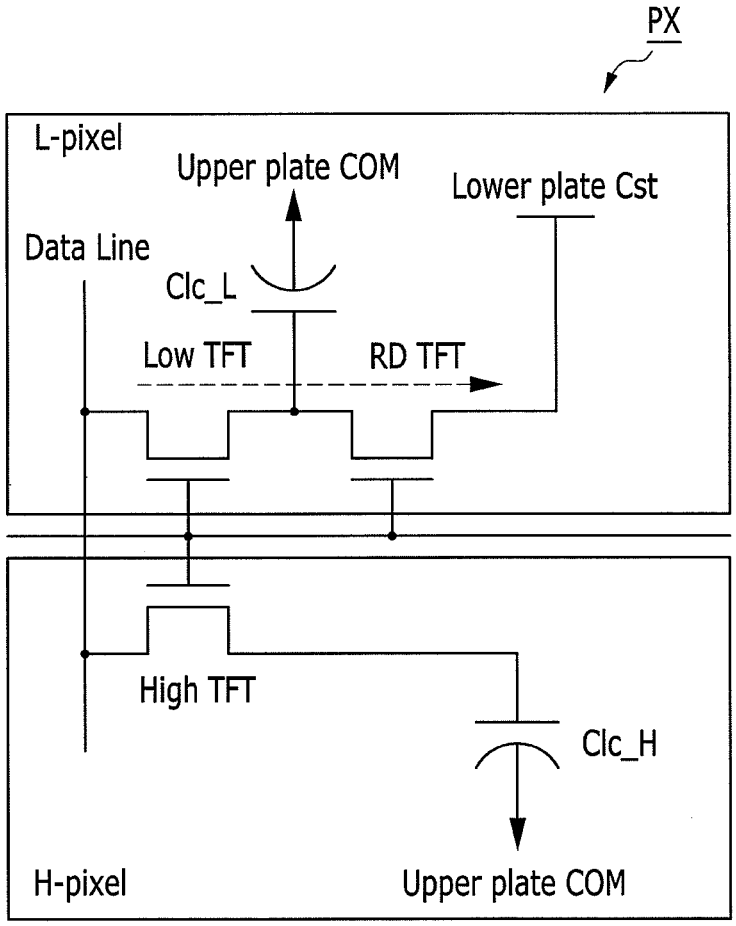
FIG. 1 is a circuit diagram of a pixel of a liquid crystal display according to an exemplary embodiment of the present invention.

The embodiments of the present invention will be described more fully hereinafter with reference to the accompanying drawings, in which the thickness of layers, films, panels, regions, etc., may be exaggerated for clarity. Like reference numerals may designate like or similar elements throughout the specification and the drawings. It will be understood that when an element such as a layer, film, region, or substrate is referred to as being "on" another element, it can be directly on the other element or intervening elements may also be present.

Hereinafter, a liquid crystal display according to an exemplary embodiment of the present invention will be described with reference to FIGS. 1 and 2.

Figure 2:
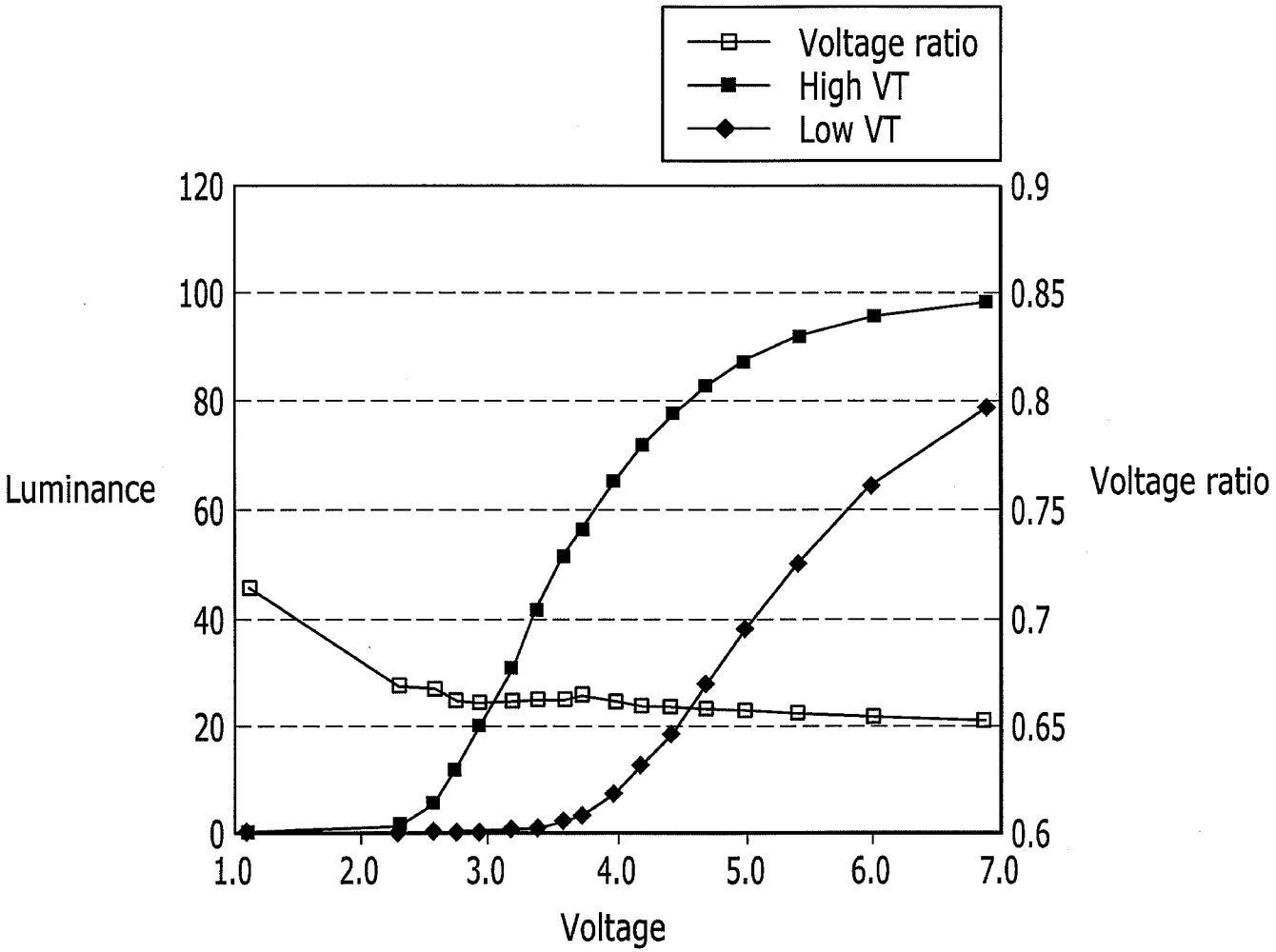
FIG. 2 is a graph of luminance versus voltage in a pixel of a liquid crystal display according to an exemplary embodiment of the present invention.

FIG. 1 is a circuit diagram of a pixel of a liquid crystal display according to an exemplary embodiment of the present invention, and FIG. 2 is a graph of luminance versus voltage in a pixel of a liquid crystal display according to an exemplary embodiment of the present invention.

Referring to FIG. 1, one pixel includes two subpixels (a high gray subpixel H-pixel and a low gray subpixel L-pixel). Two subpixels H-pixel and L-pixel respectively include switching elements High TFT and Low TFT connected to the same data line and gate line. Control terminals of the switching elements High TFT and Low TFT are connected to the same gate line, and input terminals of the switching elements High TFT and Low TFT are connected to the same data line. An output terminal of the high gray switching element High TFT is connected to a high gray subpixel electrode, and an output terminal of the low gray switching element Low TFT is connected to a low gray subpixel electrode. The high gray subpixel electrode and the low gray subpixel electrode respectively form a high gray liquid crystal capacitor Clc_H and a low gray liquid crystal capacitor Clc_L together with an upper common electrode upper plate COM.

The low gray subpixel L-pixel further includes an auxiliary switching element RD TFT. The auxiliary switching element RD TFT is also referred to as a resistance dividing switching element. A control terminal of the auxiliary switching element RD TFT is connected to the same gate line as the switching elements High TFT and Low TFT, and an input terminal of the auxiliary switching element RD TFT is connected to the output terminal of the low gray switching element Low TFT. Alternately, the input terminal of the auxiliary switching element RD TFT is connected to the low gray subpixel electrode. An output terminal of the auxiliary switching element RD TFT is connected with a storage electrode denoted by 'lower plate Cst'. The storage electrode (lower plate Cst) is connected through a storage electrode line (not shown), and storage voltage Vcst is applied to the storage electrode. In other embodiments, the input terminal of the auxiliary switching element RD TFT may be connected with the storage electrode and the output terminal of the auxiliary switching element RD TFT may be connected to the output terminal of the low gray switching element Low TFT. That is, one of the input terminal and the output terminal of the auxiliary switching element RD TFT is connected with the storage electrode and the other terminal of the auxiliary switching element RD TFT is connected to the output terminal of the low gray switching element Low TFT.

When a gate-on signal is applied to the gate line, a data voltage is transferred to each subpixel electrode through the switching elements High TFT and Low TFT. In the high gray subpixel H-pixel, the data voltage is entirely transferred to the high gray subpixel electrode, but in the low gray subpixel L-pixel, a voltage lower than the data voltage of the high gray subpixel H-pixel is transferred to the low gray subpixel due to the auxiliary switching element RD TFT. Specifically, when the gate-on voltage is applied to the gate line, the data voltage is transferred to the output terminal through a channel of the low switching element Low TFT and a part of the voltage transferred to the output terminal is transferred to the low gray subpixel electrode, and a part of the voltage transferred to the output terminal is discharged to the storage electrode (lower plate Cst) through the auxiliary switching element RD TFT. As such, the data voltage transferred to the low gray subpixel electrode varies depending on a resistance of the auxiliary switching element RD TFT and a storage voltage Vcst applied to the storage electrode (lower plate Cst). In the low gray subpixel structure, the resistance of the auxiliary switching element RD TFT is difficult to change since the value of the resistance is kept constant when the pixel is manufactured. However, since the voltage applied to the storage electrode (lower plate Cst), e.g., the storage voltage Vcst, can be changed, the data voltage transferred to the low gray subpixel electrode can be controlled by changing the storage voltage Vcst.

According to an exemplary embodiment of the present invention, the storage voltage Vcst applied to the storage electrode (lower plate Cst) is varied according to inputted image data (also referred to as RGB data). The data voltage applied through the data line is also varied by changing a reference voltage Vref and a lookup table LUT. The reference voltage Vref and the lookup table LUT for varying the data voltage have various examples. Hereinafter, an example where the reference voltage Vref is a reference voltage for generating a gray voltage, which is also referred to as a 'gamma reference voltage', and the lookup table LUT is a lookup table used in an accurate color capture (ACC) process, which is also referred to as a 'lookup table for ACC', will be described.

According to an embodiment, the circuit structure of the pixel shown in FIG. 1 is applied to a pixel elongated in a vertical direction (hereinafter, referred to as a vertical pixel) as well as a pixel elongated in a horizontal direction (hereinafter, referred to as a horizontal pixel). Since it is difficult to add a separate configuration for charge sharing (CS) between the high gray subpixel and the low gray subpixel to the horizontal pixel due to a reduction in transmittance, the pixel structure of adding only the auxiliary switching element RD TFT to the horizontal pixel as shown in FIG. 1 may be used.

FIG. 2 illustrates luminance characteristics according to a voltage applied to the pixel of FIG. 1.

Referring to FIG. 2, in which a horizontal axis represents voltage values and has two luminance values for inputted voltage, two luminance curves are shown. The upper luminance curve is implemented by the high gray subpixel H-pixel and has higher luminance values, and the lower luminance curve is implemented by the low gray subpixel L-pixel and has lower luminance values. When the pixel is viewed from a side, a combination of two luminance values respectively from the subpixels H-pixel and L-pixel is detected, and as a result, side visibility of the display device can be improved.

The values indicated in the graph of FIG. 2 have been measured with the storage voltage Vcst kept constant, and the values may be thus changed by varying the storage voltage Vcst. A voltage ratio of FIG. 2 means a ratio between voltages respectively applied to the high gray subpixel and the low gray subpixel with respect to a predetermined storage voltage Vcst.

According to an exemplary embodiment of the present invention, the storage voltage Vcst is varied according to inputted image data. Side visibility according to a variation in the storage voltage Vcst is described with reference to FIG. 3.

Figure 3:
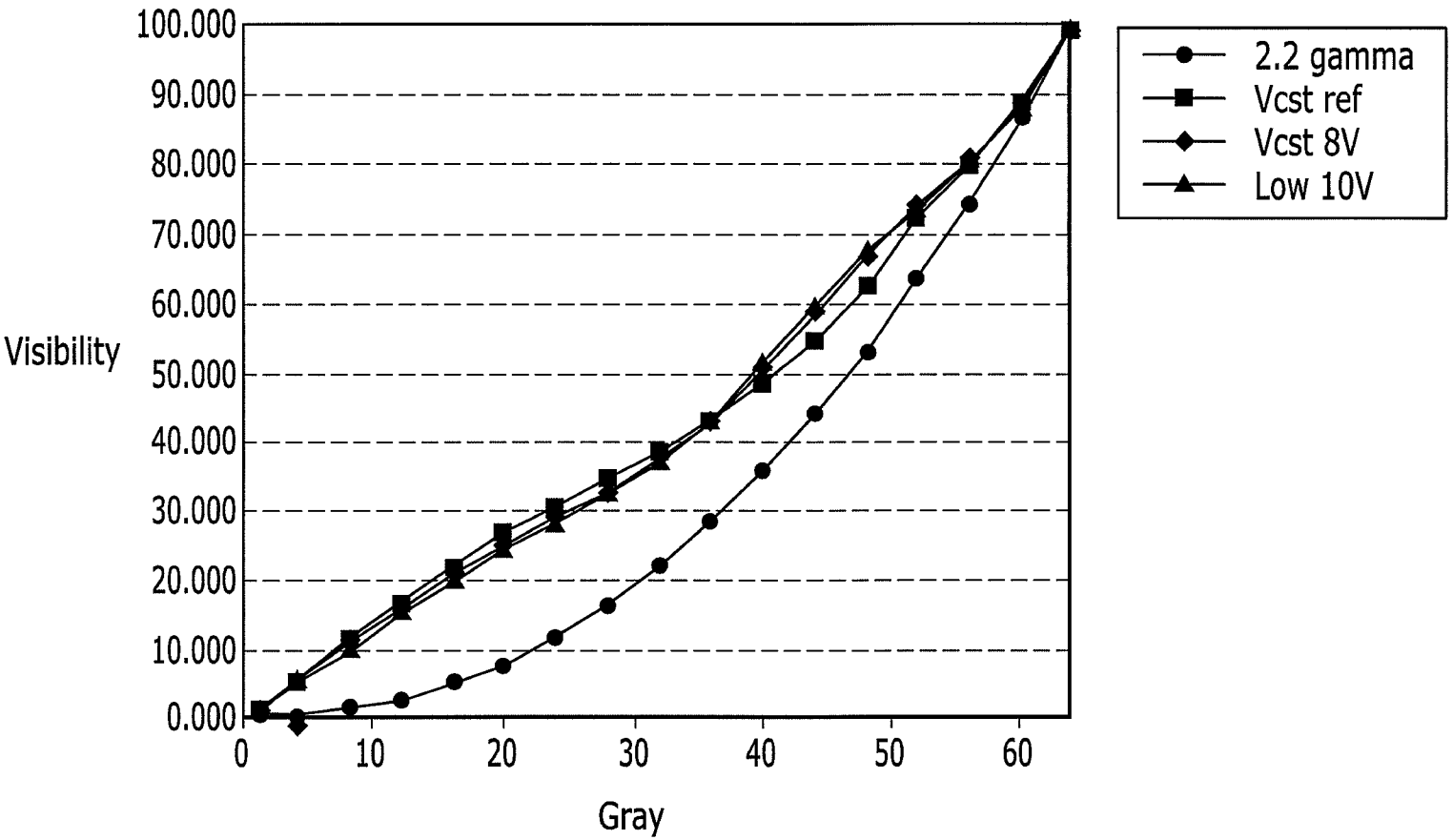
FIG. 3 is a graph showing side visibility characteristics according to voltage of a storage electrode in a pixel of a liquid crystal display according to an exemplary embodiment of the present invention.

FIG. 3 is a graph showing side visibility characteristics according to voltage of a storage electrode in a pixel of a liquid crystal display according to an exemplary embodiment of the present invention.

Referring to FIG. 3, a horizontal axis represents gray values, and a vertical axis represents side visibility. In FIG. 3, a total of 64 grays is provided as an example.

Referring to FIG. 3, side visibility indicated by a pixel including a high gray subpixel and a low gray subpixel is changed according to a variation in a storage voltage Vcst. When a storage reference voltage Vcst ref is applied as the storage voltage Vcst with respect to a middle gray or more, a difference between the storage voltage Vcst and a 2.2 gamma curve which is a reference gamma curve is reduced. Accordingly, for the middle gray or more, applying the storage reference voltage Vcst ref as the storage voltage Vcst can improve side visibility. Herein, the storage reference voltage Vcst ref is 6.5V. However, the storage reference voltage is not limited thereto and other values may be adopted for the storage reference voltage according to an exemplary embodiment.

For the middle gray or less, when 10V is applied as the storage voltage Vcst, a difference between the storage voltage and the 2.2 gamma curve is decreased.

Since the data of FIG. 3 has been measured under predetermined conditions, the data may be changed according to an exemplary embodiment. When a display device includes the pixel structure of FIG. 1, the side visibility of the display device can be changed by varying the storage voltage Vcst as shown in FIG. 3.

The side visibility can be improved by changing the data voltage applied to the data line. The data voltage can be changed by varying the reference voltage Vref and lookup table LUT, and accordingly, the side visibility can be improved by changing the reference voltage Vref and the lookup table LUT.

As a consequence, the side visibility can be improved by changing at least one of the storage voltage Vcst, the reference voltage Vref, and the lookup table LUT. Hereinafter, a method of changing all of three elements of a storage voltage Vcst, a reference voltage Vref, and a lookup table LUT according to an exemplary embodiment of the present invention is described with reference to FIGS. 4 to 6.

Figure 4:
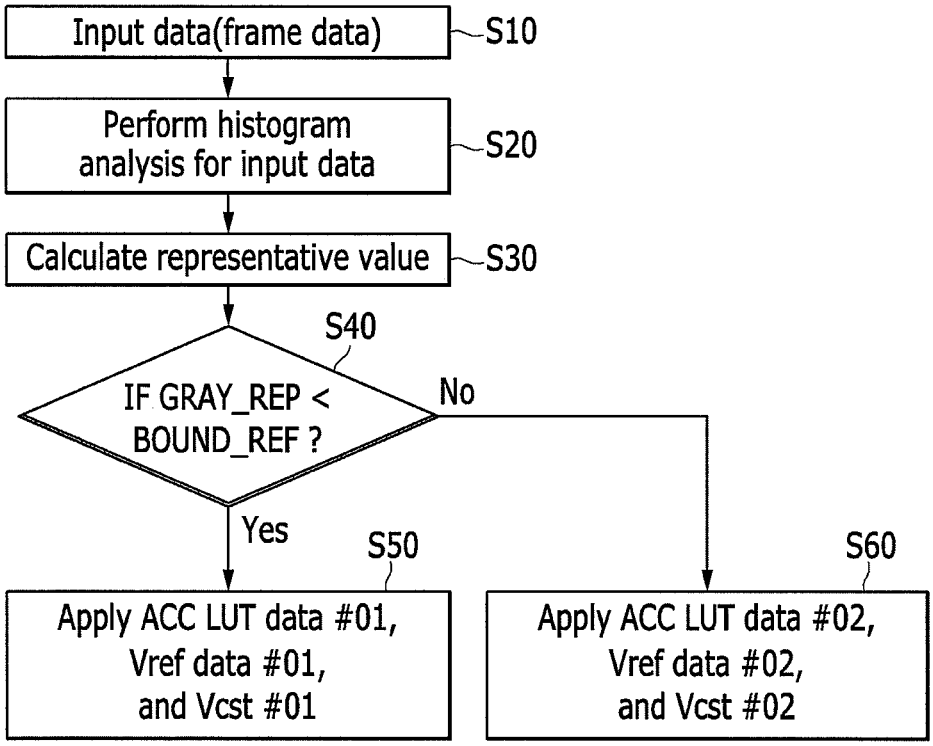
FIG. 4 is a flowchart illustrating a driving method of a liquid crystal display according to an exemplary embodiment of the present invention.
Figure 5:
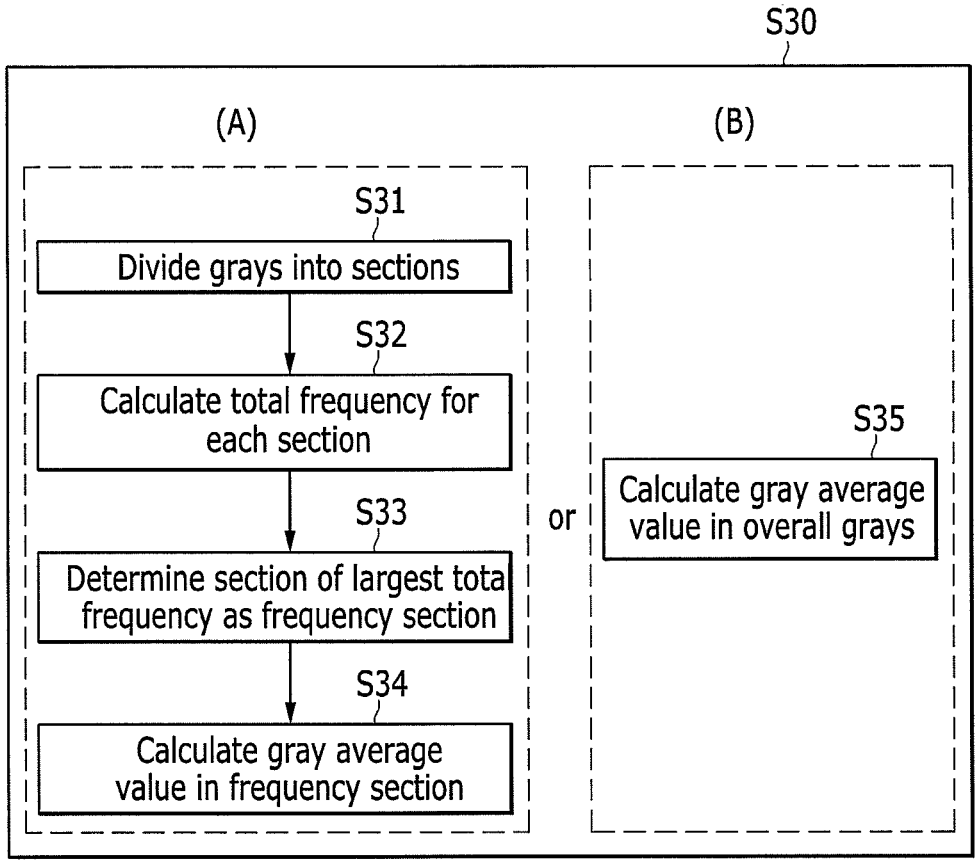
FIG. 5 is a flowchart illustrating a method of calculating a representative value in a driving method of a liquid crystal display according to an exemplary embodiment of the present invention.

FIG. 4 is a flowchart illustrating a driving method of a liquid crystal display according to an exemplary embodiment of the present invention, FIG. 5 is a flowchart illustrating in more detail a method of calculating a representative value in a driving method of a liquid crystal display according to an exemplary embodiment of the present invention, and FIG. 6 is a graph analyzing a histogram for RGB data during one frame in a liquid crystal display according to an exemplary embodiment of the present invention.

Since a storage voltage Vcst, a reference voltage Vref, and a lookup table LUT are applied to all pixels during one frame, it is determined based on image data applied to all the pixels during one frame whether the storage voltage Vcst, the reference voltage Vref, and the lookup table LUT are changed or not.

According to an exemplary embodiment, after determining a representative gray among grays of the image data applied to all the pixels during one frame, the storage voltage Vcst, the reference voltage Vref, and the lookup table LUT are changed according to the determined representative gray.

Referring to FIG. 4, the driving method of a liquid crystal display includes receiving input data during one frame (S10), analyzing a histogram for the received input data (e.g., RGB data) (S20), and calculating a representative gray value GRAY_REP for one frame (S30).

Hereinafter, a process of calculating an actual representative value GRAY_REP is included in the driving method, which is based on a liquid crystal display having a resolution of 1280*1024 and input data having 256 grays.

The input data is inputted during one frame (S10) and is analyzed (S20).

Figure 6A:
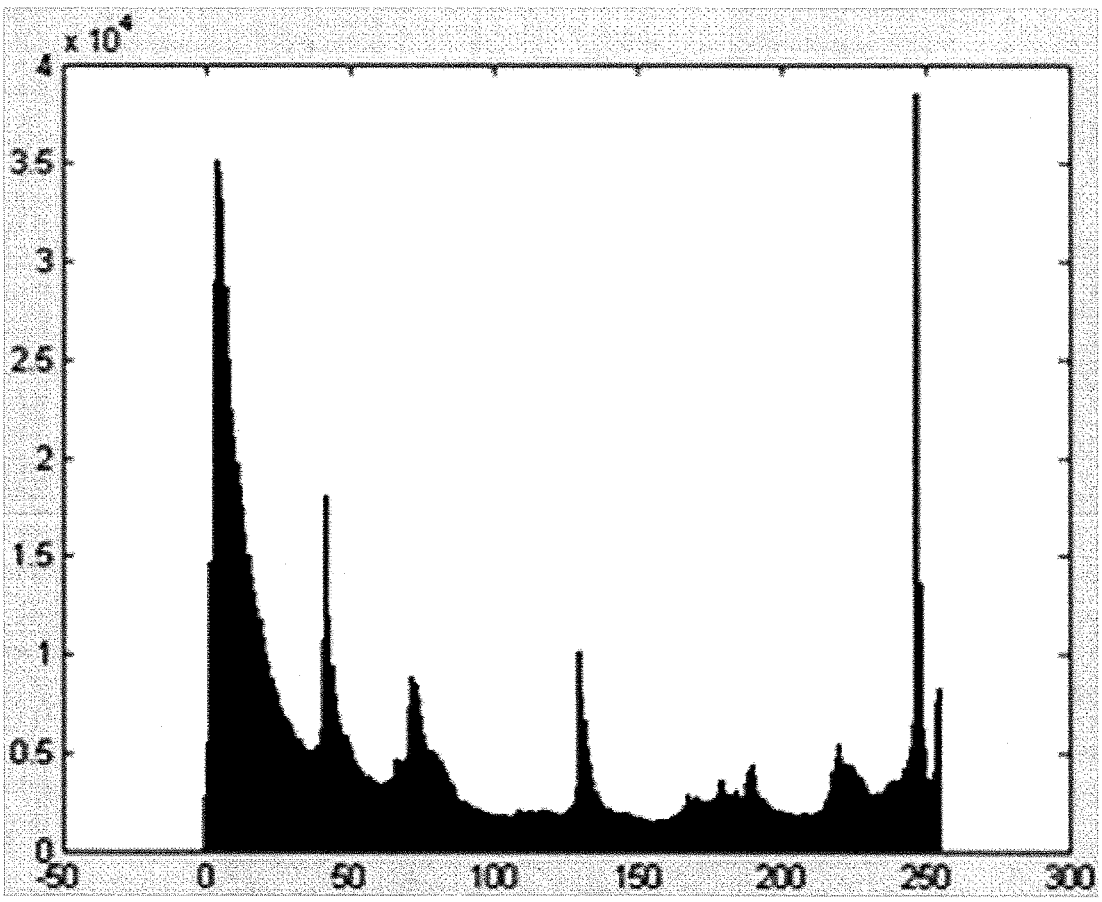
FIG. 6 is a graph analyzing a histogram for RGB data during one frame in a liquid crystal display according to an exemplary embodiment of the present invention.
Figure 6B:
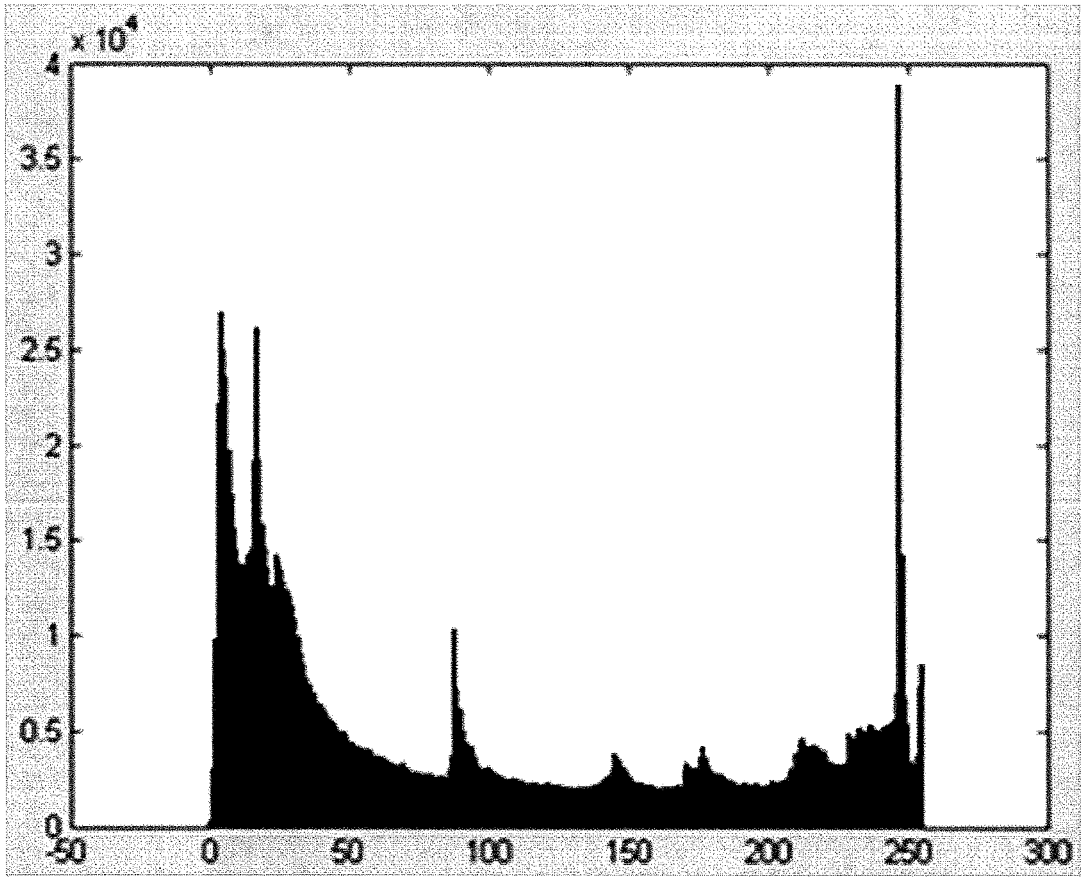
Figure 6C:
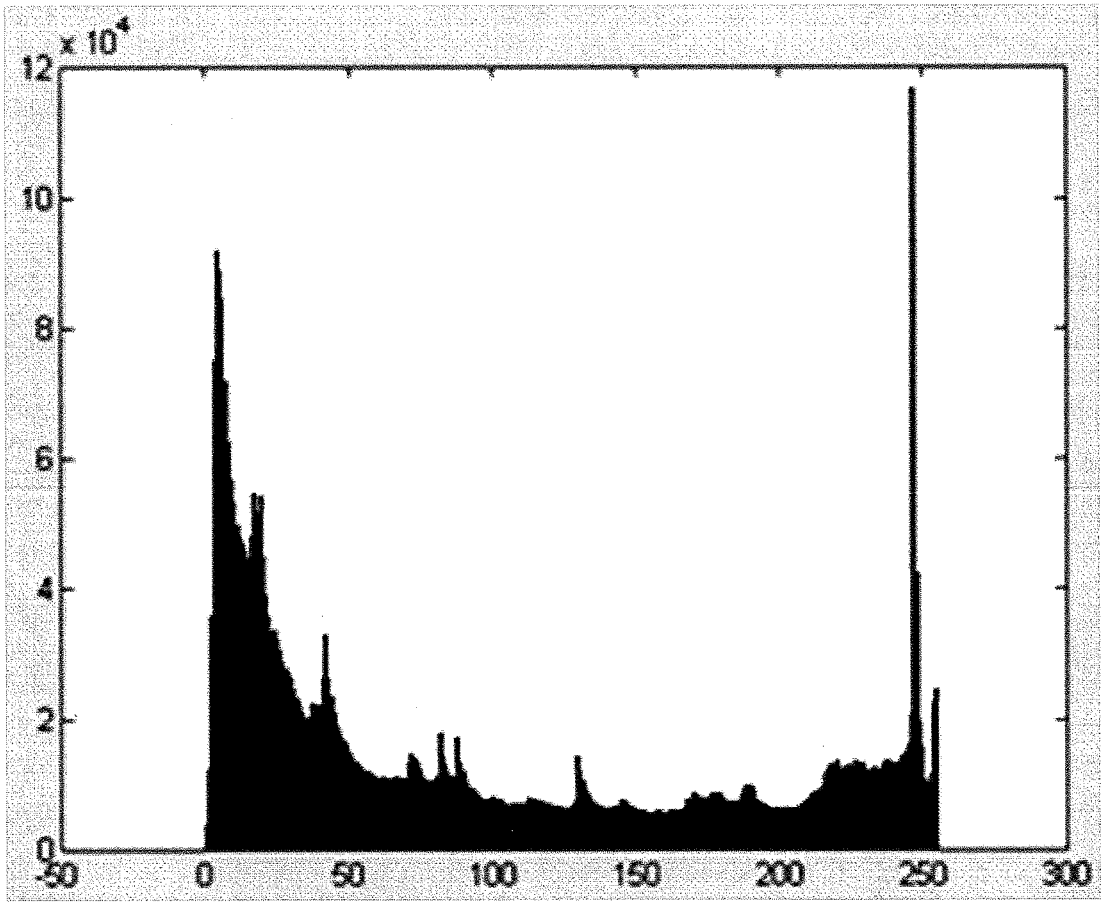
Figure 6D:
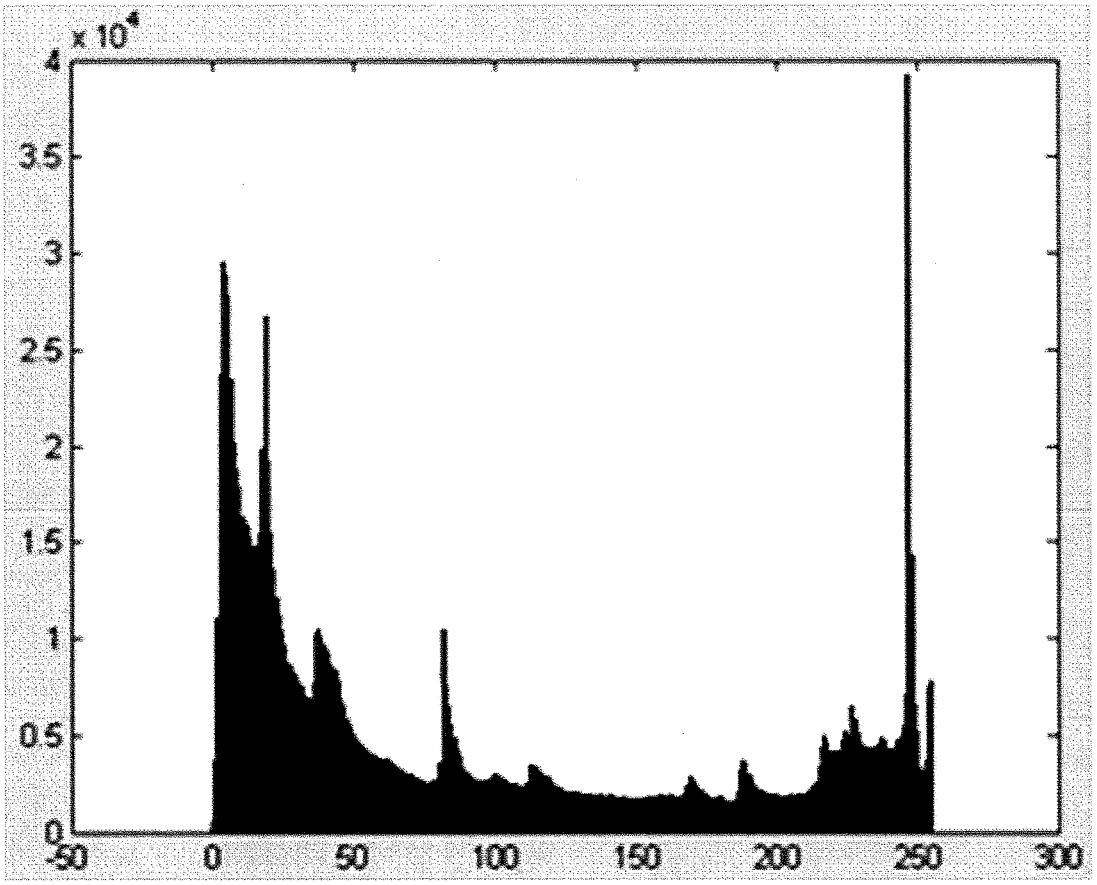

The input data includes gray data for each subpixel of red R, green G, and blue B. FIG. 6 illustrates analysis results of the input data. In each graph of FIG. 6, a horizontal axis represents grays, and a vertical axis represents frequencies indicating how often the data of the corresponding gray is included. FIG. 6A shows data for a blue B subpixel as frequencies relative to grays, FIG. 6B shows data for a red R subpixel as frequencies relative to grays, FIG. 6C shows data for all of the red, green, and blue as subpixels as frequencies relative to grays, and FIG. 6D shows data for a green G subpixel as frequencies relative to grays.

According to an exemplary embodiment, a representative value is determined based on the entire input data, only data having a largest frequency among data for red R, green G, and blue B, or only data for green G having a largest importance in the entire luminance.

Hereinafter, determining a representative value GRAY_REP based on the entire input data (RGB data), which is a combination of data for red R, green G, and blue B, is described.

The representative value GRAY_REP can be determined by various methods, two examples of which are shown in FIG. 5.

According to an exemplary embodiment of FIG. 5A, the representative value GRAY_REP is determined through the following steps:

To calculate the representative value GRAY_REP, total 256 grays of 0 to 255 are divided into a plurality of sections (S31). According to an exemplary embodiment, the total 256 grays are divided into eight sections, and 32 grays are included in each of the sections.

Thereafter, a total frequency for each section is calculated by the following Equation 1 using the frequencies (values of the vertical axis) in a histogram of FIG. 6 (S32).

$$M_j = \sum_{i=(j-1)\times 32}^{j\times 32-1} C_i \qquad \text{[Equation 1]}$$

$$M_j = \sum_{i=(j-1)\times 32}^{j\times 32-1} C_i$$

Herein, Ci is the frequency of an i-th gray, j is an integer between 1 and 8 representing the eight sections, and Mj represents a total frequency of a j-th section.

By comparing the M1 to M8 values calculated through Equation 1, a section having a largest value (hereinafter, referred to as a frequency section) is determined (S33). A total frequency M for each section according to FIG. 6 is like the following Table 1.

TABLE 1

| | Section | | | | | | | |
|---|---|---|---|---|---|---|---|---|
| | 1 (0-31) | 2 (32-63) | 3 64-95 | 4 (96-127) | 5 (128-159) | 6 (160-191) | 7 (192-223) | 8 (224-255) |
| Total frequency (M) | 1,460,281 | 562,367 | 374,196 | 225,387 | 224,120 | 238,113 | 266,588 | 581,108 |

From the calculation results in Table 1, the first section is the frequency section for the input data of FIG. 6.

Thereafter, a gray average value in the frequency section is calculated through the following Equation 2 only for the first section which is the frequency section (S34), and the calculated gray average value is determined as a representative value GRAY_REP.

$$\text{GRAY_REP} = \frac{\sum_{i=0}^{i=31} (C_i \times i)}{\sum_{i=0}^{i=31} C_i} \quad \text{[Equation 2]}$$

Herein, i is a gray, and Ci is the frequency of an i-th gray.

Equation 2 targets only the grays of 0 to 31 since the frequency section is the first section. When an actual frequency section is one of the second to the eighth sections, a changed gray range may be changed.

In the exemplary embodiment of FIG. 5A, to determine the representative value GRAY_REP, the 256 grays are divided into eight sections, so that targets for calculation are reduced to allow the calculation to be relatively easily performed, thus resulting in a reduction in the necessary time for calculation. However, the embodiments are not limited thereto, and according to an embodiment, the 256 grays can be divided into 256 sections. According to an exemplary embodiment, the section division is not performed, an example of which is shown in FIG. 5B.

In the exemplary embodiment of FIG. 5B, in the calculating of the representative value GRAY_REP (S30), an average value for all the grays is calculated by using the following Equation (S35) as the representative value GRAY_REP.

$$\text{GRAY_REP} = \frac{\sum_{i=0}^{i=255} (C_i \times i)}{\text{No of all } RGB \text{ pixels in image}} \quad \text{[Equation 3]}$$

Herein, i is a gray, Ci is the frequency of an i-th gray, and 'No of all RGB pixels in image' refers to a resolution of 1280'1024, wherein when each pixel has subpixels of R, G, and B, No of all RGB pixels in image is 1280*1024*3.

In the exemplary embodiments described in connection with FIG. 5, the gray average value is used to calculate the representative value GRAY_REP. According to an embodiment, to improve display quality for a predetermined gray, while calculating the gray average value, a weight value is added to the predetermined gray.

Referring back to FIG. 4, after the representative value GRAY_REP is calculated (S30), the representative value GRAY_REP is compared with a reference value BOUND_REF (S40). Herein, the reference value BOUND_REF is one of control parameters stored in a signal controller T-CON or a peripheral memory, and the reference value BOUND_REF can be changed from the outside.

According to an exemplary embodiment of the present invention, the storage voltage Vcst, the reference voltage Vref, and the lookup table LUT are controlled based on a comparison result of the representative value GRAY_REP and the reference value BOUND_REF.

In FIG. 4, one reference value BOUND_REF is shown. When the representative value GRAY_REP is smaller than the reference value BOUND_REF, a first storage voltage Vcst #01, first reference voltage Vref data #01, and first lookup table ACC LUT data #01 are selected to display images (S50). When the representative value GRAY_REP is larger than the reference value BOUND_REF, a second storage voltage Vcst #02, second reference voltage Vref data #02, and second lookup table ACC LUT data #02 are selected to display images (S60).

Two or more of the reference values BOUND_REF are included according to an exemplary embodiment. According to an embodiment, the storage voltage Vcst, the reference voltage Vref, and the lookup table LUT are allocated with respect to each of the two or more reference values BOUND_REF.

According to an exemplary embodiment, all of the storage voltage Vcst, the reference voltage Vref, and the lookup table LUT are not stored. For example, only some of the three elements of the storage voltage Vst, the reference voltage Vref, and the lookup table LUT are stored, and the other elements are calculated based on the stored elements. When all of the storage voltage Vcst, the reference voltage Vref, and the lookup table LUT are stored, a large storage space is required, but all of the storage voltage Vcst, the reference voltage Vref, and the lookup table LUT can be applied without a separate process. Calculating and generating the storage voltage Vcst, the reference voltage Vref, and the lookup table LUT requires a generation time, but provides a reduced storage space and improved display quality by responding to various changes of the display device Steps S10 to S40 in FIGS. 4 and 5 are performed in a histogram analysis block (see 300 of FIGS. 7 to 9) disposed inside or outside the signal controller T-CON, and changing of the storage voltage Vcst, the reference voltage Vref, and the lookup table LUT (S50 and S60) is performed based on a command of the histogram analysis block 300.

Figure 7:
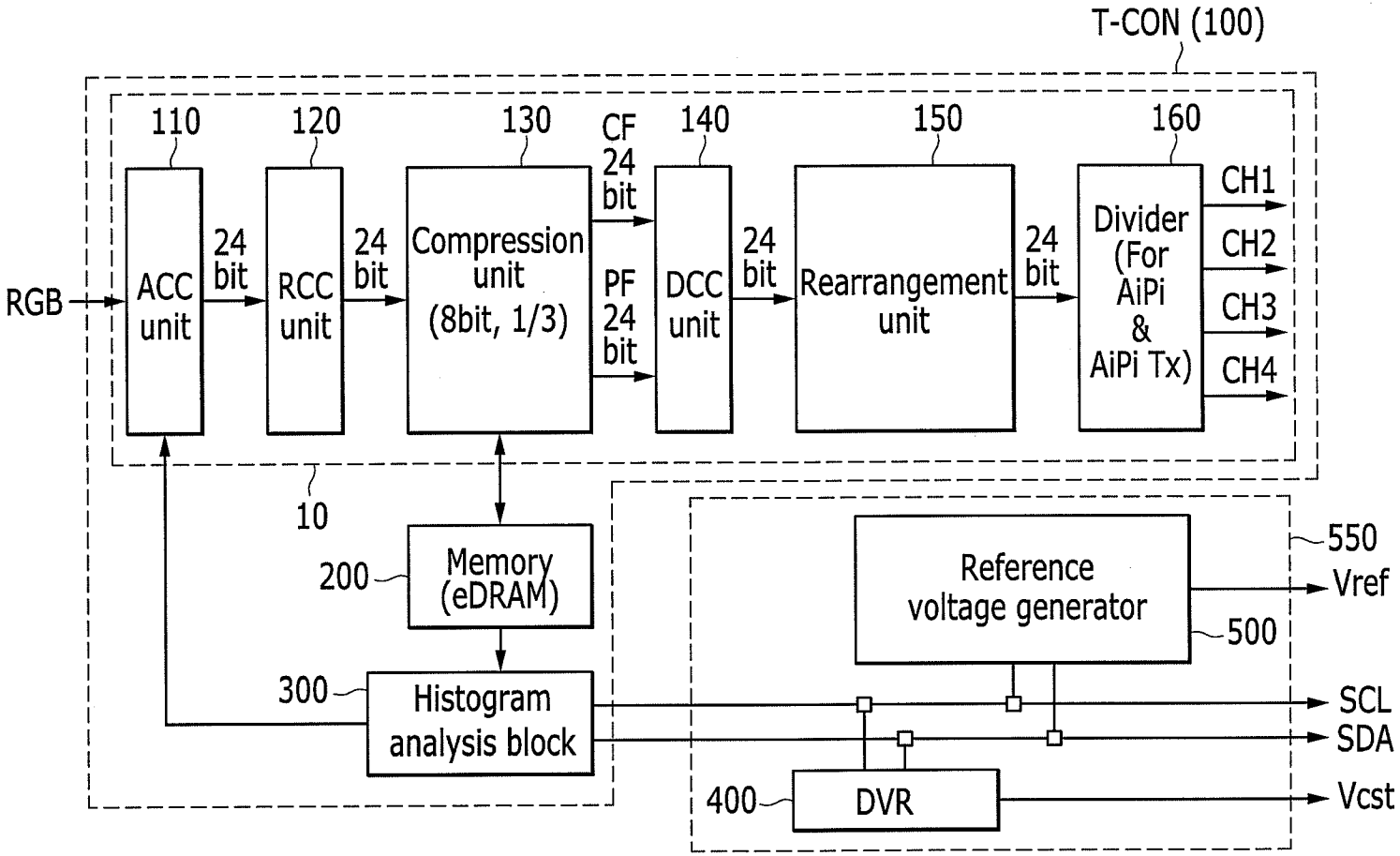
FIG. 7 is a block diagram showing a signal controller and a driving voltage generator of a liquid crystal display according to an exemplary embodiment of the present invention.
Figure 8:
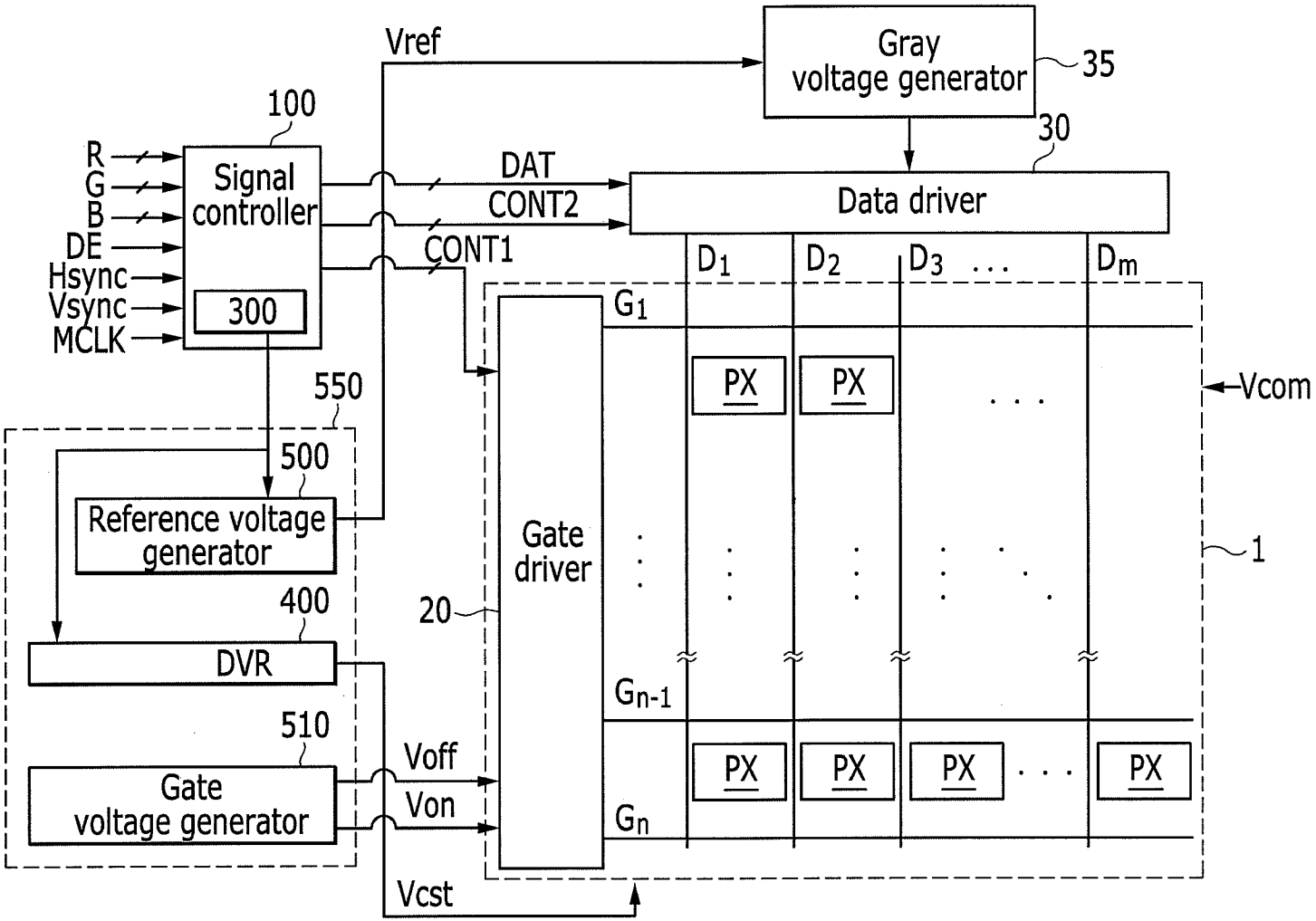
FIG. 8 is a block diagram of a liquid crystal display according to an exemplary embodiment of FIG. 7.

FIG. 7 is a block diagram showing a signal controller and a driving voltage generator of a liquid crystal display according to an exemplary embodiment of the present invention, and FIG. 8 is a block diagram of a liquid crystal display according to an exemplary embodiment of the present invention.

FIG. 7 shows that a histogram analysis block 300 is disposed inside a signal controller T-CON 100. According to an embodiment, the histogram analysis block 300 is positioned outside the signal controller T-CON 100.

The signal controller 100 includes an image data processor 10, a memory (e.g., eDRAM) 200, and a histogram analysis block 300.

The image data processor 10 transfers RGB data inputted from an outside source (not shown) to a data driver 30 (see FIG. 8) through a series of processes. The image data processor 10 has various structures according to an exemplary embodiment, and the image data processor 10 according to the exemplary embodiment of FIG. 7 has the following structure.

The image data processor 10 includes an accurate color capture (ACC) unit 100, a replacement capacitance compensation (RCC) unit 120, a compression unit 130, a dynamic capacitance compensation (DCC) unit 140, a rearrangement unit 150, and a divider 160.

The ACC unit 100 gamma-corrects the RGB data inputted from the outside source based on a predetermined corrected gamma value (stored in a lookup table for an ACC) according to a gamma characteristic of the display device and outputs the corrected RGB data.

The corrected RGB data is transferred from the ACC unit to the RCC unit 120. The RCC unit 120, which assists the DCC unit 140 to improve a response speed of the liquid crystals, corrects the inputted RGB data.

The RGB data corrected by the RCC unit 120 is transferred to and compressed by the compression unit 130. According to an exemplary embodiment, the RGB data is 24 bits long and compressed into 8 bits which is a third of the original 24 bits. The compression unit 130 then stores the compressed RGB data in the memory 200. According to an embodiment, the memory 200 is a frame memory, such as, for example, an eDRAM or the like, and a memory capacity of the memory 200 can be reduced by compressing and storing the data. The compression unit 130 reads image data PF of a previous frame from the memory 200 and releases the image data into 24 bits and transfers the released image data to the DCC unit 140. The compression unit 130 transfers image data CF of a current frame in 24 bits without compression.

The DCC unit 140 corrects the image data CF of the current frame to a predetermined corrected value based on a difference between the image data CF of the current frame and the image data PF of the previous frame to improve the response speed of the liquid crystals. According to an embodiment, the predetermined corrected value is stored in the lookup table LUT for the DCC.

The RGB data processed in the DCC unit 140 is transferred to the rearrangement unit 150. The rearrangement unit 150 rearranges the array of the RGB data according to a structure of the display device. For example, the rearrangement unit 150 rearranges the RGB data according to whether the display device has a horizontal pixel or a vertical pixel and the number and array of the pixels disposed on the display panel. According to an embodiment, since a dummy pixel is formed around a pixel displaying an image in the display panel, and data (referred to as dummy data) needs to be applied to the dummy pixel, the RGB data is arranged considering the dummy pixel. The dummy data is inserted to have a predetermined value while the RGB data is rearranged by the rearrangement unit 150.

According to an embodiment, the pixel structure of FIG. 1 is further suitable for a horizontal pixel, and when the display device has the horizontal pixel, the rearrangement unit 150 rearranges the RGB data according to the pixel structure.

The RGB data rearranged according to the structure of the display panel is transferred to the divider 160, and the divider 160 cuts the RGB data according to a data transmission/reception standard. For example, FIG. 7 shows an example where the RGB data is cut into four to be transmitted through four channels CH1, CH2, CH3, and CH4 according to an advanced intra panel interface (AiPi) method (AiPi & AiPi Tx) which is one of the high-speed series communication technologies.

The structure and the operation of the image data processor 10 are changed according to an exemplary embodiment.

The RGB data compressed in the compression unit 130 and stored in the memory 200 is transferred to the histogram analysis block 300. The histogram analysis block 300 performs steps S10 to S40 of FIG. 4 based on the RGB data transferred from the memory 200. A change to a storage voltage Vcst, a reference voltage Vref, and a lookup table LUT for ACC selected as a result of performing step S40 is performed by the following method.

The ACC unit 110 is notified with the selected lookup table LUT from the histogram analysis block 300, and based on the selected changed lookup table LUT, the ACC unit 110 converts the RGB data to have color information corresponding to the changed storage voltage Vcst and the reference voltage Vref. As such, the change of the lookup table LUT for ACC is simply performed in the signal controller 100.

The storage voltage Vcst and the reference voltage Vref are changed in association with an external constituent element, such as a driving voltage generator 550, of the signal controller 100.

The signal controller 100 transmits and receives signals from/to the external driving voltage generator 550 through a I2C interface. For example, a clock signal passes through a SCL line of the I2C interface, and a command data passes through a SDA line of the I2C interface. According to an exemplary embodiment of the present invention, data commanding the changes of the storage voltage Vcst and the reference voltage Vref is transferred during a vertical blank period of the image signal.

When a command of the histogram analysis block 300 is transferred to the DVR (Digital Variable Resistor) 400 through the I2C interface, a variable resistance value in the DVR 400 is changed, and the changed storage voltage Vcst is outputted.

When a command of the histogram analysis block 300 is transferred to the reference voltage generator 500 through the I2C interface, the reference voltage Vref is changed, and the changed reference voltage Vref is outputted. According to an embodiment, the reference voltage generator 500 includes a programmable voltage generating integrated circuit, such as, for example, GinieLite.

According to an exemplary embodiment, the signal controller 100 and the driving voltage generator 550 shown in FIG. 7 are formed on a PCB/PBA board (control board). According to an exemplary embodiment, the change of the storage voltage Vcst and the reference voltage Vref is performed not in the signal controller 100 but in the PCB/PBA board (control board).

The storage voltage Vcst, the reference voltage Vref, and the lookup table LUT are stored in a bundle according to an exemplary embodiment. For example, according to an embodiment, a first bundle includes the storage voltage Vcst #01, first reference voltage Vref data #01, and first lookup table ACC LUT data #01, and a second bundle includes the second storage voltage Vcst #02, second reference voltage Vref data #02, and second lookup table ACC LUT data #02 as shown in steps S50 and S60 of FIG. 4.

FIG. 7 specifically illustrates only the process of the RGB data and the change of the storage voltage Vcst, the reference voltage Vref and the lookup table LUT, while FIG. 8 schematically illustrates a structure and a signal transfer of the overall liquid crystal display.

Referring to FIG. 8, the liquid crystal display includes a signal controller 100 including a histogram analysis block 300, a DVR 400, a driving voltage generator 550 including a reference voltage generator 500 and a gate voltage generator 510, a liquid crystal panel 1, a gate driver 20, a gray voltage generator 35, and a data driver 30.

The liquid crystal panel 1 includes a plurality of pixels PX arranged in a matrix form. According to an embodiment, each of the pixels PX has a structure shown in FIG. 1. Each of the pixels PX has a horizontal pixel structure in which the pixel PX is shaped as a rectangle whose length in a horizontal direction is longer than a length in a vertical as shown in FIG. 8. According to an embodiment, the pixel PX also has a vertical pixel structure which is shaped as a rectangle whose length in the vertical direction is longer than a length in the horizontal direction.

The liquid crystal panel 1 includes a plurality of signal lines G1 to Gn and D1 to Dm connected to the plurality of pixels PX. Since the panel 1 includes horizontal pixels, the number of data lines D1 to Dm is small and the number of gate lines G1 to Gn is large, as compared with a liquid crystal panel including vertical pixels.

One pixel PX represents one primary color and represents a desired color together with adjacent pixels PX.

The driving voltage generator 550 includes a DVR 400 generating a storage voltage Vcst, a reference voltage generator 500 generating a reference voltage Vref, and a gate voltage generator 510 generating gate on/off voltages Von and Voff.

The reference voltage Vref generated by the reference voltage generator 500 is transferred to the gray voltage generator 35 to become a reference voltage (also, referred to as a gamma reference voltage) for generating a gray voltage. The data driver 30 applies the gray voltage generated by the gray voltage generator 35 using a control signal CONT2 and image data DAT to the data lines D1 to Dm as data voltage.

The gate voltage generator 510 generates the gate-on voltage Von and the gate-off voltage Voff and transfers the voltages Von and Voff to the gate driver 20. The gate driver 20 alternately applies the gate-on voltage Von and the gate-off voltage Voff to the gate lines G1 to Gn according to a control signal CONT1 of the signal controller.

The DVR 400 generates a storage voltage Vcst and transfers the generated storage voltage Vcst to a storage electrode (a lower plate Cst of FIG. 1) of each pixel PX in the liquid crystal panel 1.

The driving voltage generator 550 further includes a common voltage generator (not shown) that generates a common voltage Vcom. The generated common voltage Vcom is applied to a common electrode (an upper plate COM of FIG. 1) of the liquid crystal panel 1.

The signal controller 100 controls the gate driver 20, the data driver 30, and the driving voltage generator 550. The signal controller 100 includes a histogram analysis block 300. The storage voltage Vcst and the reference voltage Vref which are respectively outputted from the DVR 400 and the reference voltage generator 500 are changed by the output of the histogram analysis block 300. Although not shown in FIG. 8, the output of the histogram analysis block 300 is transferred to the ACC unit 110 in the signal controller 100 to change the lookup table LUT.

The lookup table for ACC has been described above in connection with FIGS. 7 and 8. However, the embodiments of the present invention are not limited thereto, and. another lookup table (for example, a lookup table for DCC) used in the signal controller 100 can be changed according to an exemplary embodiment.

Figure 9:
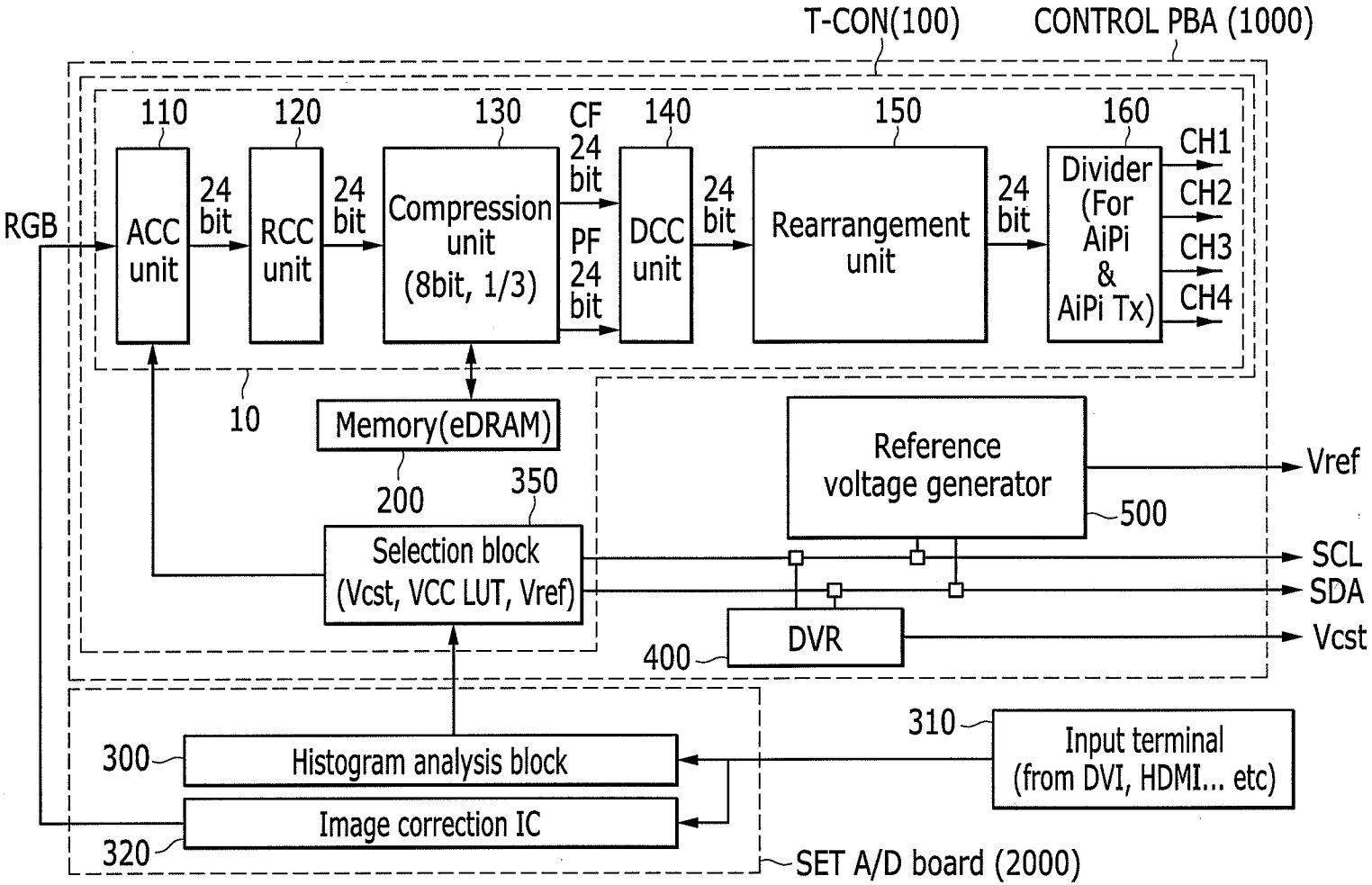
FIG. 9 is a block diagram showing a signal controller and a driving voltage generator of a liquid crystal display according to an exemplary embodiment of the present invention.

FIG. 9 is a graph showing a signal controller and a driving voltage generator of a liquid crystal display according to an exemplary embodiment of the present invention.

In the exemplary embodiment of FIG. 9, unlike the exemplary embodiment of FIG. 7, a histogram analysis block 300 is disposed outside a signal controller 100. The histogram analysis block 300 is also disposed on an A/D (analog-digital) board (SET A/D board) 2000, but not on a control board CONTROL PBA 1000 on which the signal controller 100 is disposed. The A/D board 2000 is a separate board from the control board 1000. The A/D board 2000 receives a signal from an input terminal 310 and transfers the received signal to the control board 1000 including signal controller 100. The A/D board 2000 converts a signal inputted through a predetermined interface, such as a DVI or a HDMI, into a signal of a predetermined format and transfers the converted signal to the signal controller 100. The A/D board 2000 also converts an inputted analog signal into a digital signal.

An integrated circuit (hereinafter, referred to as an image correction IC 320) for converting the inputted image data is mounted on the A/D board 2000. According to an embodiment, the histogram analysis block 300 is a block disposed in the image correction IC 320 or is separately disposed outside the image correction IC 320 as shown in FIG. 9. According to an embodiment, both the image correction IC 320 and the histogram analysis block 300 of FIG. 9 are included in one integrated circuit.

When a target storage voltage Vcst, a target reference voltage Vref, and a target lookup table LUT to which current storage voltage, reference voltage, and lookup table are changed are determined by the histogram analysis block 300 performing steps S10 to S40, information on the target storage voltage Vcst, the target reference voltage Vref, and the target lookup table LUT is transferred to a selection block 350 in the control board 1000. According to an embodiment, the transfer of the information from the histogram analysis block 300 on the A/D board 2000 to the selection block 350 on the control board 1000 is performed through an I2C interface or through a separate wire.

The selection block 350 changes the current lookup table LUT for ACC, storage voltage Vcst, and reference voltage Vref based on the information received from the histogram analysis block 300.

The exemplary embodiment of FIG. 9 is different from the exemplary embodiment of FIG. 7 in that the histogram analysis is performed before the RGB data is applied to the ACC unit 110 and that the memory 200 does not need to transfer the RGB data to the histogram analysis block 300.

When the histogram analysis is performed with the RGB data to which the ACC has been applied as shown in FIG. 7, since a color characteristic directly applied to the pixel is applied by the ACC process, the histogram analysis is performed based on the data displayed in the display panel, such that an accurate gray analysis can be performed.

According to an embodiment, the image correction IC 320 and the histogram analysis block 300 can be formed at one integrated circuit. According to an embodiment, since the image correction IC 320 previously disposed on the A/D board 2000 can be modified to incorporate the histogram analysis block 300 so that a separate IC for the histogram analysis block 300 is unnecessary.

While the embodiments of the invention have been described, it is to be understood that the invention is not limited to the embodiments, but, on the contrary, is intended to cover various modifications and equivalent arrangements included within the spirit and scope of the appended claims.

What is claimed is:

1. A liquid crystal display comprising:

a display panel connected to a gate line and a data line and including a pixel receiving a storage voltage;

a data driver connected to the data line and applying a data voltage to the data line;

a gate driver connected to the gate line and applying a gate voltage to the gate line;

a gray voltage generator connected to the data driver and generating a gray voltage based on a reference voltage;

a driving voltage generator generating a driving voltage;

a signal controller controlling the data driver, the gate driver, and the driving voltage generator and correcting input image data with reference to a lookup table; and a histogram analysis block histogram-analyzing the image data during one frame and changing at least one of the storage voltage, the reference voltage, and the lookup table, wherein the driving voltage generator includes a digital variable resistor generating the storage voltage; and a reference voltage generator generating the reference voltage, and, wherein the histogram analysis block transfers an output signal to the digital variable resistor and the reference voltage generator and changes the storage voltage and the reference voltage.

2. The liquid crystal display of claim 1, wherein the signal controller includes an accurate color capture unit and a dynamic capacitance compensation unit and wherein the lookup table is used in the accurate color capture unit or the dynamic capacitance compensation unit.

3. The liquid crystal display of claim 2, wherein the signal controller further includes at least one of a replacement capacitance compensation unit, a compression unit, a rearrangement unit, and a divider.

4. The liquid crystal display of claim 1, wherein the histogram analysis block is disposed inside the signal controller.

5. The liquid crystal display of claim 1, further comprising:

a control board including the signal controller and the driving voltage generator; and an A/D board including an image correction integrated circuit converting an image signal inputted from an outside source into a predetermined format and transferring the converted image signal to the signal controller.

6. The liquid crystal display of claim 5, wherein the histogram analysis block is formed on the analog-digital board.

7. The liquid crystal display of claim 6, wherein the histogram analysis block is formed in the image correction integrated circuit.

8. The liquid crystal display of claim 1, wherein the pixel includes a high gray subpixel and a low gray subpixel, wherein the high gray subpixel includes a high gray liquid crystal capacitor and a high gray switching element, and the low gray subpixel includes a low gray liquid crystal capacitor, a low gray switching element, and an auxiliary switching element, and wherein a terminal of the auxiliary switching element receives the storage voltage.

9. A liquid crystal display, comprising:

a display panel connected to a gate line and a data line and including a pixel receiving a storage voltage;

a data driver connected to the data line and applying a data voltage to the data line;

a gate driver connected to the gate line and applying a gate voltage to the gate line;

a gray voltage generator connected to the data driver and generating a gray voltage based on a reference voltage;

a driving voltage generator generating a driving voltage;

a signal controller controlling the data driver, the gate driver, and the driving voltage generator and correcting input image data with reference to a lookup table; and a histogram analysis block histogram-analyzing the image data during one frame and changing at least one of the storage voltage, the reference voltage, and the lookup table, wherein the pixel includes a high gray subpixel and a low gray subpixel, wherein the high gray subpixel includes a high gray liquid crystal capacitor and a high gray switching element, and the low gray subpixel includes a low gray liquid crystal capacitor, a low gray switching element, and an auxiliary switching element, and wherein a terminal of the auxiliary switching element receives the storage voltage, and wherein an input terminal of the auxiliary switching element is connected to an output terminal of the low gray switching element, and control terminals of the auxiliary switching element and the low gray switching element are connected to the gate line.

10. The liquid crystal display of claim 8, wherein the pixel is a horizontal pixel or a vertical pixel.

11. A driving method of a liquid crystal display, comprising:

receiving input data from an outside source during one frame;

analyzing a histogram for the received input data;

calculating a representative value based on the histogram analysis; and changing at least one of a storage voltage, a reference voltage, and a lookup table based on the representative value, wherein calculating the representative value includes, dividing grays into sections;

calculating a total frequency for each section;

determining a section having a largest total frequency as a frequency section; and calculating a gray average value in the frequency section and determining the gray average value as the representative value.

12. The method of claim 11, wherein calculating the representative value includes calculating a gray average value in the entire grays and determining the gray average value as the representative value.

13. The method of claim 11, wherein analyzing the histogram for the received input data includes analyzing the histogram for the entire input data or only green data of the input data.

14. The method of claim 11, wherein changing at least one of the storage voltage, the reference voltage, and the lookup table based on the representative value includes comparing the representative value with a predetermined reference value and changing at least one of the storage voltage, the reference voltage, and the lookup table according to a comparison result.

* * * * *